US006411248B1

(12) United States Patent
Barbour et al.

(10) Patent No.: US 6,411,248 B1
(45) Date of Patent: Jun. 25, 2002

(54) HOT MELT RADAR ABSORBING MATERIAL (RAM)

(75) Inventors: April A. Barbour, Centreville, VA (US); Deirdre S. Crutchfield, Tucson, AZ (US)

(73) Assignee: Raytheon Company, Lexington, MA (US)

( * ) Notice: Subject to any disclaimer, the term of this patent is extended or adjusted under 35 U.S.C. 154(b) by 23 days.

(21) Appl. No.: 09/671,951

(22) Filed: Sep. 27, 2000

Related U.S. Application Data

(60) Provisional application No. 60/159,178, filed on Oct. 13, 1999.

(51) Int. Cl.[7] ..... H01Q 17/00

(52) U.S. Cl. ..... 342/1; 342/2; 342/3; 342/4; 427/140; 428/403

(58) Field of Search ..... 342/1, 2, 3, 4; 427/140, 142, 282, 356; 428/328, 375, 145, 212, 379, 388, 389, 403, 701; 252/62.54, 62.56, 62.6, 62.62, 62.64; 523/136, 137, 220; 524/413, 424, 431, 435, 440

(56) References Cited

U.S. PATENT DOCUMENTS 3,721,982 A * 3/1973 Wesch ..... 342/1
4,116,906 A * 9/1978 Ishino et al. ..... 523/137
4,535,032 A * 8/1985 Sirinyan et al. ..... 428/629
4,657,786 A * 4/1987 Sirinyan et al. ..... 427/304
5,147,718 A * 9/1992 Papoulias et al. ..... 428/328
5,552,455 A * 9/1996 Schuler et al. ..... 523/137
5,645,886 A * 7/1997 Schueler, II et al. ..... 427/140
5,756,207 A * 5/1998 Clough et al. ..... 428/375
5,764,181 A * 6/1998 Fey et al. ..... 342/2
5,993,569 A * 11/1999 Simon et al. ..... 148/307

* cited by examiner

*Primary Examiner*—John B. Sotomayor
(74) *Attorney, Agent, or Firm*—Colin M. Raufer; Leonard A. Alkov; Glenn H. Lenzen, Jr.

(57) ABSTRACT

A glue-gun applied hot-melt radar-absorbing material (RAM) and method of use thereof is provided. The hot-melt radar-absorbing material composition comprises: (a) 70 to 85 wt % carbonyl iron powder; (b) 2 to 10 wt % of a metal deactivator; and (c) balance a thermoplastic polyurethane. The method for repair of a body comprising a radar-absorbing material, comprises: (a) formulating the hot-melt radar-absorbing material of the present invention; (b) forming the hot-melt radar-absorbing material into a shape; (c) applying the hot-melt radar-absorbing material in a molten state onto the body; and (d) allowing the hot-melt radar-absorbing material to cool to room temperature. The shape of the hot-melt RAM is advantageously a "glue stick", which is configured to go into a glue gun. The repair operator loads the glue stick into the glue gun and pulls the trigger. The glue gun heats the glue stick, and the molten material is applied to the area to be repaired. The material hardens instantly on application. In contrast to the 11-½ hours required by the prior art RAM, repair time is 22 minutes for two applications, employing the RAM of the present invention.

16 Claims, No Drawings

HOT MELT RADAR ABSORBING MATERIAL (RAM)

CROSS-REFERENCE TO RELATED APPLICATION

The present application is a non-provisional application, and claims priority based on provisional application, Ser. No. 60/159,178, filed on Oct. 13, 1999.

This invention was made with United States Government support under Contract No. F34601-96-C-0775 awarded by the Department of the Air Force. The U.S. Government has certain rights in this invention.

TECHNICAL FIELD

The present invention relates generally to radar-absorbing materials used for reducing detectable cross-section of an aircraft, such as a missile, and, more particularly, to a method for repairing such radar-absorbing materials.

BACKGROUND ART

Radar-absorbing materials are used to reduce detectability of aircraft, such as missiles. However, there are times where the radar-absorbing material is ablated or otherwise damaged, thereby rendering the aircraft more detectable by radar.

Currently, repairs to the radar-absorbing material are made with a two-part polyurethane (thermoset) to which a magnetic particle filler is added. The repair operator must (1) weigh out all three materials, which requires about 5 to 10 minutes, (2) mix half the filler into each part of the polyurethane, which requires an additional 10 to 15 minutes, (3) mix the two polyurethane parts together, which requires another 5 to 10 minutes, and (4) apply the material. The polyurethane must then cure for 5 hours before repair procedures can continue. After the polyurethane cures, the repair operator must sand the repair until smooth. This usually uncovers voids in the material that resulted from air entrapped during the mixing operation. The entrapped air is unable to rise to the surface before the material cures. If there are voids in the material after sanding, the repair operator must repeat the procedure to fill them. The repair time is 11-½ hours for two applications.

One aerospace company demonstrated a hot melt RAM in 1995. The material remained very soft, and was not suitable for use. Further development was apparently discontinued.

Another aerospace company later came out with a hot-melt RAM as well, but did not demonstrate it. That material is no longer in use. It appears that there may have been adhesion problems.

Thus, a need remains for a rapid means of effecting repairs to radar-absorbing materials.

DISCLOSURE OF INVENTION

In accordance with the present invention, a glue-gun applied hot-melt radar-absorbing material and method of use thereof is provided which avoids most, if not all, of the prior art problems.

The hot-melt radar-absorbing material composition comprises:

(a) 70 to 85 wt % carbonyl iron powder;

(b) 2 to 10 wt % of a metal deactivator; and (c) balance a thermoplastic polyurethane.

The method for repair of a body comprising a radar-absorbing material, comprises:

(a) formulating the hot-melt radar-absorbing material of the present invention;

(b) forming the hot-melt radar-absorbing material into a shape;

(c) applying the hot-melt radar-absorbing material in a molten state onto the body; and (d) allowing the hot-melt radar-absorbing material to cool to room temperature.

In the present invention, the shape of the hot-melt RAM is advantageously a "glue stick", which is configured to go into a glue gun. The repair operator loads the glue stick into the glue gun and pulls the trigger. The glue gun heats the glue stick, and the molten material is applied to the area to be repaired. The material hardens instantly on application. In contrast to the 11-½ hours required by the prior art RAM, repair time is 22 minutes for two applications, employing the RAM of the present invention.

BEST MODES FOR CARRYING OUT THE INVENTION

Reference is made now in detail to a specific embodiment of the present invention, which illustrates the best mode presently contemplated by the inventors for practicing the invention. Alternative embodiments are also briefly described as applicable.

In accordance with the invention, a hot melt RAM composition is provided. The hot melt composition comprises about 70 to 85 wt % of carbonyl iron powder, about 2 to 10 wt % of a metal deactivator, and the balance a thermoplastic polyurethane (one-component). The presence of the metal deactivator is required, due to the tendency of carbonyl iron to react with the polymer to break its backbone, thereby lowering the melt temperature to about 180° F. (about 82° C.). The metal deactivator prevents that reaction, and keeps the melt temperature of the polyurethane polymer in the range of about 350° F. (about 177° C.).

An example of a thermoplastic polyurethane is Elastolan C-95-A, available from BASF (Wyandotte, Mich.), which is a polyester-based polyurethane. The thermoplastic polyurethane, which is a one-component system, softens at about 350° F. (about 177° C.). Examples of other one-component, thermoplastic polyurethanes include the following from BASF (Wyandotte, Mich.): 1100 Series, 600 Series, C Series, and S Series; from Bayer (Pittsburgh, Pa.): Desmopan (polyester-based) series and Texin (polyester-based) series; from Dow (Midland, Mich.): Isoplas (polyether-based) series and Pellethane (polyester- and polyether-based) series; and from Stevens Urethane (Holyoke, Mass.): MP series.

Carbonyl iron powder is available from Byte Mark (Orlando, Fla.), Reade Advanced Materials (Riverside, R.I.), and Roschem Pacific Group (Australia).

An example of a metal deactivator is Irganox MD 1024, which is believed to be a hindered phenolic stabilizer, e.g., 1,2-bis(3,5-di-tert-butyl-4-hydroxyhydrocinnamoyl) hydrazine, available from CibaGeigy (Tarrytown, N.Y.). Other examples of metal deactivators include Eastman Inhibitor OABH-EF, which is an oxalylbis(benzylidene-hydrazide), available from Eastman Chemical (Kingsport, Tenn.), and Naugard XL-1, which is a high performance, dual functional phenolic antioxidant/metal deactivator, e.g., 2,2'-oxamido bis-(ethyl 3-(3,5-di-tert-butyl-4-hydroxyphenyl) propionate, available from Uniroyal (Middlebury, Conn.).

In preparing the formulation of the present invention, the metal deactivator is added to the thermoplastic polyurethane by melting the polyurethane and mixing in the metal deactivator. Once the metal deactivator is added, then the carbonyl iron powder is mixed into the melt. The melt is then allowed to cool to room temperature (about 20 to 25° C.).

Although the order of addition is critical (metal deactivator before carbonyl iron), the particular method is not critical. There are many other ways to prepare the formulation of the present invention in addition to the melt process described above. For example, powders of the metal deactivator and polyurethane may be ground together, followed by addition of carbonyl iron powder.

In any event, once the three components are mixed together, the resulting formulation is formed into glue sticks of the requisite dimensions to be used in a glue gun. As is well-known in this art, the glue gun heats the glue stick, thereby melting the formulation, which is then easily applied as necessary. The molten RAM flows onto the site being repaired.

Once applied as a melt to the desired surface, the formulation undergoes rapid hardening in cooling to room temperature. The solidified formulation may be reworked with a soldering iron to smooth the formulation, which, upon re-solidification, may be further smoothed by sanding.

The RAM formulation of the present invention is intended for repairs of small areas, such as seams; repair of large areas is not presently contemplated.

EXAMPLE

A formulation in accordance with the present invention was prepared, having the following composition:

| | |
|---|---|
| Elastolan C-95-A | 13.5 wt % (thermoplastic polyurethane); |
| Carbonyl iron powder | 82.5 wt % (magnetic particle filler); and |
| Irganox MD-1024 | 4 wt % (metal deactivator). |

The formulation was prepared by melting the polyurethane, adding the metal deactivator, and then adding the carbonyl iron into the melt. The formulation was formed into glue sticks having dimensions 2 inches in diameter, up to 6 inches long and placed in a Hysol 4100 glue gun. The formulation was applied to an aluminum panel coated with radar absorbing material that was intentionally damaged.

The solidified formulation was subjected to a variety of tests, including lap shear, tensile tests, radar cross-section (RCS) testing at the range and on an interferometer, solvent/fuel splash tests, thermo-mechanical analysis, and exposure of 6 inch×6 inch aluminum panels coated with melt RAM to heat, humidity, and salt fog. The test results are listed in the Table below.

| | Required | Actual |
|---|---|---|
| Hardness | 45 Shore D (min.) | 50 Shore D |
| Tensile strength | (no requirement) | 1,564 psi |
| shear strength | 168 psi | 220 psi |
| salt fog | coin tap | pass |
| heat/hum | coin tap | pass |
| Radar cross-section: | | |
| attenuation ≧ 9 dB @ X Band (specular) | | pass |

-continued

| | Required | Actual |
|---|---|---|
| attenuation ≧ 5 dB @ X Band (traveling wave) | | pass |
| solvent/fuel resistance: 1. Aeroshell 7 grease 2. MIL 5606 hydraulic oil 3. 50% propylene glycol 4. RJ-4 fuel 5. JP-10 fuel | <10% hardness degradation | pass |
| melt temperature, $T_m$ | 176° F. < $T_m$ < 400° F. | 350° F. |

The results shown in the Table indicate that the radar-absorbing material of the present invention meets or exceeds the requirements for such materials.

INDUSTRIAL APPLICABILITY

The formulation is expected to find use in the repair of small areas on radar-absorbing materials.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. Similarly, any process steps described might be inter-changeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents.

What is claimed is:

1. A hot-melt radar-absorbing material composition comprising:

(a) 70 to 85 wt % carbonyl iron powder;

(b) 2 to 10 wt % of a metal deactivator; and (c) the balance a one-component thermoplastic polyurethane, wherein said metal deactivator prevents any reaction between said carbonyl iron powder and said polyurethane that would lower said polyurethane's melt temperature.

2. The composition of claim 1 comprising:

(a) about 82.5 wt % carbonyl iron powder;

(b) about 4 wt % of said metal deactivator; and (c) about 13.5 wt % of said thermoplastic polyurethane.

3. The composition of claim 1 wherein said metal deactivator is selected from the group consisting of 1,2-bis(3,5-di-tert-butyl-4-hydroxyhydrocinnamoyl) hydrazine, an oxalylbis(benzylidenehydrazide), and 2,2'-oxamido bis-(ethyl 3-(3,5-di-tert-butyl-4-hy-droxyphenyl) propionate.

4. The composition of claim 1 wherein said thermoplastic polyurethane comprises either a polyether-based urethane or a polyester-based urethane.

5. The composition of claim 1 having a melting temperature within a range of about 176° F. (about 80° C.) to 400° F. (204° C.).

6. A method for repair of a body comprising a radar-absorbing material, comprising:

(a) formulating a hot-melt radar-absorbing material comprising (1) 70 to 85 wt % carbonyl iron powder;

(2) 2 to 10 wt % of a metal deactivator; and (3) the balance a one-component thermoplastic polyurethane, wherein said metal deactivator prevents any reaction between said carbonyl iron powder and said polyurethane that would lower said polyurethane's melt temperature;

(b) forming said hot-melt radar-absorbing material into a shape;

(c) applying said hot-melt radar-absorbing material in a molten state onto said body; and (d) allowing said hot-melt radar-absorbing material to cool to room temperature.

7. The method of claim 6 wherein said hot-melt radar absorbing material comprises:

(a) about 82.5 wt % carbonyl iron powder;

(b) about 4 wt % of said metal deactivator; and (c) about 13.5 wt % of said thermoplastic polyurethane.

8. The method of claim 6 wherein said metal deactivator is selected from the group consisting of 1,2-bis(3,5-di-tert-butyl-4-hydroxyhydrocinnamoyl) hydrazine, an oxalylbis (benzylidenehydrazide), and 2,2'-oxamido bis-(ethyl 3-(3,5-di-tert-butyl-4-hy-droxyphenyl) propionate.

9. The method of claim 6 wherein said thermoplastic polyurethane comprises either a polyether-based urethane or a polyester-based urethane.

10. The method of claim 6 having a melting temperature within a range of about 176° F. (about 80° C.) to 400° F. (204° C.).

11. The method of claim 6 wherein said formulating step comprises mixing said metal deactivator with said thermoplastic polyurethane to form a first mixture and then adding said carbonyl iron powder to said first mixture to form said formulation.

12. The method of claim 11 wherein said thermoplastic polyurethane is first melted and said metal deactivator is added to said molten polyurethane to form said first mixture.

13. The method of claim 6 wherein hot-melt radar-absorbing material is formed into a glue stick for use in a glue gun that includes a heating mechanism.

14. The method of claim 13 wherein said hot-melt radar-absorbing material is applied to said body from said glue gun by melting said material.

15. The method of claim 6 further comprising:

(e) re-heating said hot-melt radar-absorbing material to smooth it; and (f) allowing said re-heated material to cool to room temperature.

16. The method of claim 15 further comprising:

(g) sanding said hot-melt radar-absorbing material to further smooth it.

* * * * *